US008157015B2

(12) United States Patent
Voss et al.

(10) Patent No.: US 8,157,015 B2
(45) Date of Patent: Apr. 17, 2012

(54) LARGE BORE VERTICAL TREE

(75) Inventors: Robert K. Voss, Peterculter (GB); David S. Christie, Aberdeen (GB); Peter Breese, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 381 days.

(21) Appl. No.: 12/417,465

(22) Filed: Apr. 2, 2009

(65) Prior Publication Data

US 2009/0255682 A1 Oct. 15, 2009

Related U.S. Application Data

(60) Provisional application No. 61/041,803, filed on Apr. 2, 2008.

(51) Int. Cl.
*E21B 43/01* (2006.01)

(52) U.S. Cl. ..... 166/368; 166/344; 166/373; 166/66.6

(58) Field of Classification Search ..... 166/368, 166/339, 341, 344, 347, 348, 351, 352, 358, 166/367, 369, 373–375, 381, 382, 386, 66.6, 166/66.7, 85.1, 88.4, 179; 175/5–10
See application file for complete search history.

(56) References Cited

U.S. PATENT DOCUMENTS

| | | | | | |
|---|---|---|---|---|---|
| 4,475,600 | A * | 10/1984 | Cegielski et al. | ..... | 166/344 |
| 4,607,691 | A * | 8/1986 | Bridges | ..... | 166/88.4 |
| 4,703,807 | A * | 11/1987 | Weston | ..... | 166/373 |
| 5,372,199 | A * | 12/1994 | Cegielski et al. | ..... | 166/368 |
| 5,971,077 | A * | 10/1999 | Lilley | ..... | 166/368 |
| 5,992,527 | A * | 11/1999 | Garnham et al. | ..... | 166/379 |
| 6,062,314 | A * | 5/2000 | Nobileau | ..... | 166/368 |
| 6,076,605 | A * | 6/2000 | Lilley et al. | ..... | 166/368 |
| 6,302,212 | B1 * | 10/2001 | Nobileau | ..... | 166/368 |
| 6,516,876 | B1 * | 2/2003 | Jennings | ..... | 166/77.51 |
| 6,520,263 | B2 * | 2/2003 | June | ..... | 166/368 |
| 6,612,368 | B2 * | 9/2003 | Bartlett et al. | ..... | 166/75.13 |
| 6,659,181 | B2 * | 12/2003 | Hartmann | ..... | 166/348 |
| 6,866,095 | B2 * | 3/2005 | Skeels | ..... | 166/133 |
| 6,942,028 | B2 * | 9/2005 | Hosie | ..... | 166/88.4 |
| 7,013,970 | B2 * | 3/2006 | Collie et al. | ..... | 166/89.1 |
| 7,025,132 | B2 * | 4/2006 | Kent et al. | ..... | 166/87.1 |
| 7,150,325 | B2 * | 12/2006 | Ireland et al. | ..... | 166/366 |
| 7,331,396 | B2 * | 2/2008 | Reimert et al. | ..... | 166/368 |
| 7,395,866 | B2 * | 7/2008 | Milberger et al. | ..... | 166/345 |
| 2004/0262010 | A1 * | 12/2004 | Milberger | ..... | 166/368 |
| 2009/0236100 | A1 * | 9/2009 | Lawson | ..... | 166/339 |
| 2010/0294492 | A1 * | 11/2010 | June et al. | ..... | 166/255.2 |

FOREIGN PATENT DOCUMENTS

GB 2397312 A1 7/2005

OTHER PUBLICATIONS

UKIPO Search Report dated Aug. 6, 2009, 4 pages, GB0905724.1.

* cited by examiner

*Primary Examiner* — Thomas A. Beach
*Assistant Examiner* — Matthew Buck
(74) *Attorney, Agent, or Firm* — Bracewell & Giuliani LLP

(57) ABSTRACT

A subsea wellhead assembly that includes a wellhead housing, a production tree, a tubing hanger adapted to land in the wellhead assembly inside the wellhead housing, and a bore formed through the production tree having an inner diameter greater than the tubing hanger outer diameter. A hanger adapter may be included having an annular body disposed on the tubing hanger upper surface and a flange member projecting radially outward from the annular body.

11 Claims, 3 Drawing Sheets

LARGE BORE VERTICAL TREE

CROSS REFERENCE TO RELATED APPLICATIONS

This application claims priority to and the benefit of U.S. Provisional Application Ser. No. 61/041,803, filed Apr. 2, 2008, the full disclosure of which is hereby incorporated by reference herein.

BACKGROUND

1. Field of Invention

This invention relates in general to production of oil and gas wells, and in particular to a wellhead having a large bore tree that includes a hanger adapter in the bore, the plug having a passage therethrough to receive a control line.

2. Description of Related Art

Wellheads used in the production of hydrocarbons extracted from subterranean formations typically comprise a wellhead assembly. Wellhead assemblies are attached at the upper ends of wellbores that intersect hydrocarbon producing formations. Wellhead assemblies also provide support for tubing and casing inserted into the wellbore. The casing lines the wellbore, thereby isolating the wellbore from the surrounding formation. The tubing typically lies concentric within the casing and provides a conduit for producing the hydrocarbons entrained within the formation.

Wellhead assemblies also typically include a production tree connecting to the upper end of the wellhead housing. The production tree controls and distributes the fluids produced from the wellbore. Valves assemblies are typically provided within wellhead production trees for controlling the flow of oil or gas from a wellhead and/or for controlling circulating fluid flow in and out of a wellhead. Gate valves and other sliding stem-type valves have a valve member or disc and operate by selectively moving the stem to insert/remove the valve member into/from the flow of fluid to stop/allow the flow when desired.

SUMMARY OF INVENTION

A subsea wellhead assembly that includes a wellhead housing, a production tree, a tubing hanger adapted to land in the wellhead assembly inside the wellhead housing, and a bore formed through the production tree having an inner diameter greater than the tubing hanger outer diameter. A hanger adapter may be included having an annular body disposed on the tubing hanger upper surface and a flange member projecting radially outward from the annular body.

DETAILED DESCRIPTION OF THE INVENTION

Figure 1:
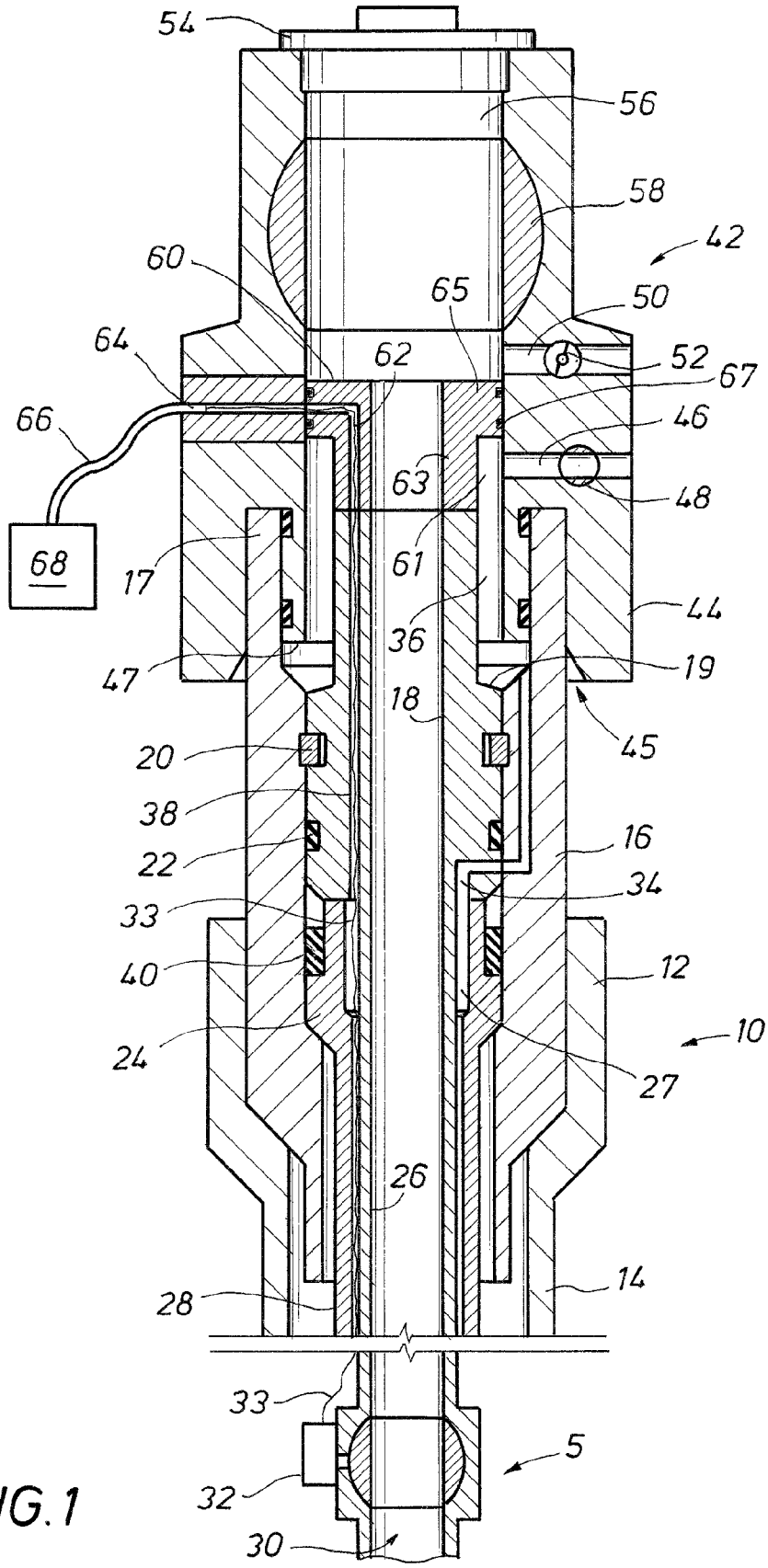
FIG. 1 is a schematical partial sectional view of an embodiment of a large bore wellhead production tree having a hanger adapter in the tree bore.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 is a side sectional schematic of an embodiment of a wellhead assembly having a full bore, or large bore, tree as part of the assembly. The wellhead assembly 10 illustrated in FIG. 1 comprises an outer wellhead housing 12 anchored in the seabed on conductor pipe 14. The conductor pipe 14 extends a predetermined distance into a wellbore 5 over which the wellhead assembly 10 is disposed. Coaxially landed within the outer wellhead housing 12 is a high pressure/inner wellbore housing 16. The high pressure wellbore housing 16 includes therein a casing hanger 24 landed on its inner circumference. A packoff 40 seals between the casing hanger 24 and the high pressure housing 16. Casing 28 is attached to the lower portion of the casing hanger 24 and is cemented into and lines the wellbore 5. A tubing hanger 18 is coaxially attached to the high pressure wellbore housing 16 by a tubing hanger latch 20 above the casing hanger 24 attachment point. A seal 22 may be provided between the tubing hanger 18 and the high pressure housing 16. Tubing 26 is suspended from the tubing hanger 18 and coaxially projects within the casing 28 to define a tubing annulus 27 therebetween. A lower actuator passage 38 is axially formed through the tubing hanger 18 and shown registering with the tubing annulus 27.

A production tree 42 also included with the wellhead assembly 10 of FIG. 1 is shown affixed on the high pressure housing 16 upper end 17. An annular channel 45 formed into the production tree 42 lower terminal surface 47 is configured to receive the high pressure housing 16 upper end. A connector 44 on the production tree 42 outer periphery couples the high pressure housing 16 to the production tree 42. Fluids produced from within the wellbore 5 that flow through the tubing 26 can be delivered to a production line (not shown) through a production outlet 50 and wing valve 52. The tubing 26, tubing hanger 18, the space in the bore 56 above the tubing hanger 18, and production outlet 50 form a production flow path. The wing valve 52 selectively controls produced fluids flow to the production line. The tree 42 of FIG. 1 includes a large annulus bore 56 axially extending through the tree 42 body. A swab valve 58 is provided in the bore 56; selectively operating the swab valve 58 can control flow and pressure through the bore 56. The bore 56 and valve 58 are optionally sized to accommodate insertion and retrieval therethrough of tubing and casing. The swab valve 58 is shown as a ball valve. Optionally, the swab valve 58 can be a gate valve.

An annular hanger adapter 60 is shown disposed on the tubing hanger 18 upper end. The hanger adapter 60 includes an annular body 63 having radial dimensions substantially matching the tubing hanger 18. The hanger adapter 60 includes a flange 65 shown atop the body 63 that radially extends outward into contact with the bore 56 inner diameter. Seals 67 are shown provided in the interface between the flange 65 and bore 56 inner diameter. A lockdown mechanism (not shown) can be used for securing the hanger adapter 60 within the tree bore 56. An upper actuator passage 62 shown passing through the flange 65 and body 63 registers with the lower actuator passage 38. Above the hanger latch 20, the tubing hanger 18 outer surface transitions radially inward away from the high pressure housing 16 creating a shoulder 19 on the tubing hanger 18. A tubing hanger annulus 36 is shown in the annular space circumscribing the tubing hanger 18 and plug body 63 between the shoulder 19 and flange 65. The tubing hanger annulus 36 outer radius is bounded by the high pressure housing 16 and tree 42.

A circulation port 46 shown passing between the plug annulus 61 and the tree 42 outer diameter includes a circulation valve 48 for annulus pressure and fluid control through the port 46. A tubing annulus passage 34 is shown bored through the tubing hanger 18 and the high pressure housing 16; the tubing annulus passage 34 provides pressure and fluid communication between the tubing hanger annulus 36 and the tubing annulus 27. The combination of the tubing annulus passage 34, tubing hanger annulus 36, and plug annulus 61 creates a flow path to the circulation of fluid into the tubing annulus 27, such as during workover operations.

A selectively openable and closeable safety valve 30 is shown in the tubing 26 that provides pressure isolation between the wellhead assembly 10 and within the wellbore 5. The safety valve 30 is operable with the actuator 32 shown on the tubing, and can be electrically or hydraulically powered. A line 33 attached to the actuator 32 is shown that can provide electrical or hydraulic power. Extending upward from the actuator 32, the line 33 follows the path through the tubing annulus 27, the lower actuator passage 38, and into the upper actuator passage 62. The upper actuator passage 62 registers with a tree control line passage 64 shown formed through the tree 42. There, the line 33 connects to a lead 66 that extends from a subsea control module 68. The control line 33 may be disposed within the lead 66 or connected thereto for transferring either hydraulic fluid or electrical current through the line. In one embodiment, a pair of control lines is provided to and from the actuator 32 to complete the electrical or hydraulic circuit. As is known, the subsea control module 68 can provide control for operating the actuator 32 as well as any actuatable elements, such as valves and sliding sleeves, associated with the wellhead assembly 10. The passages 64, 62, 38 and annulus 27 form an actuation passage. Aligning the passages within the wellhead assembly 10 may require an orientation device when landing the hanger adapter 60 within the wellhead assembly 10. It is well within the capabilities of those skilled in the art to create and implement such an orientation.

Figure 2:
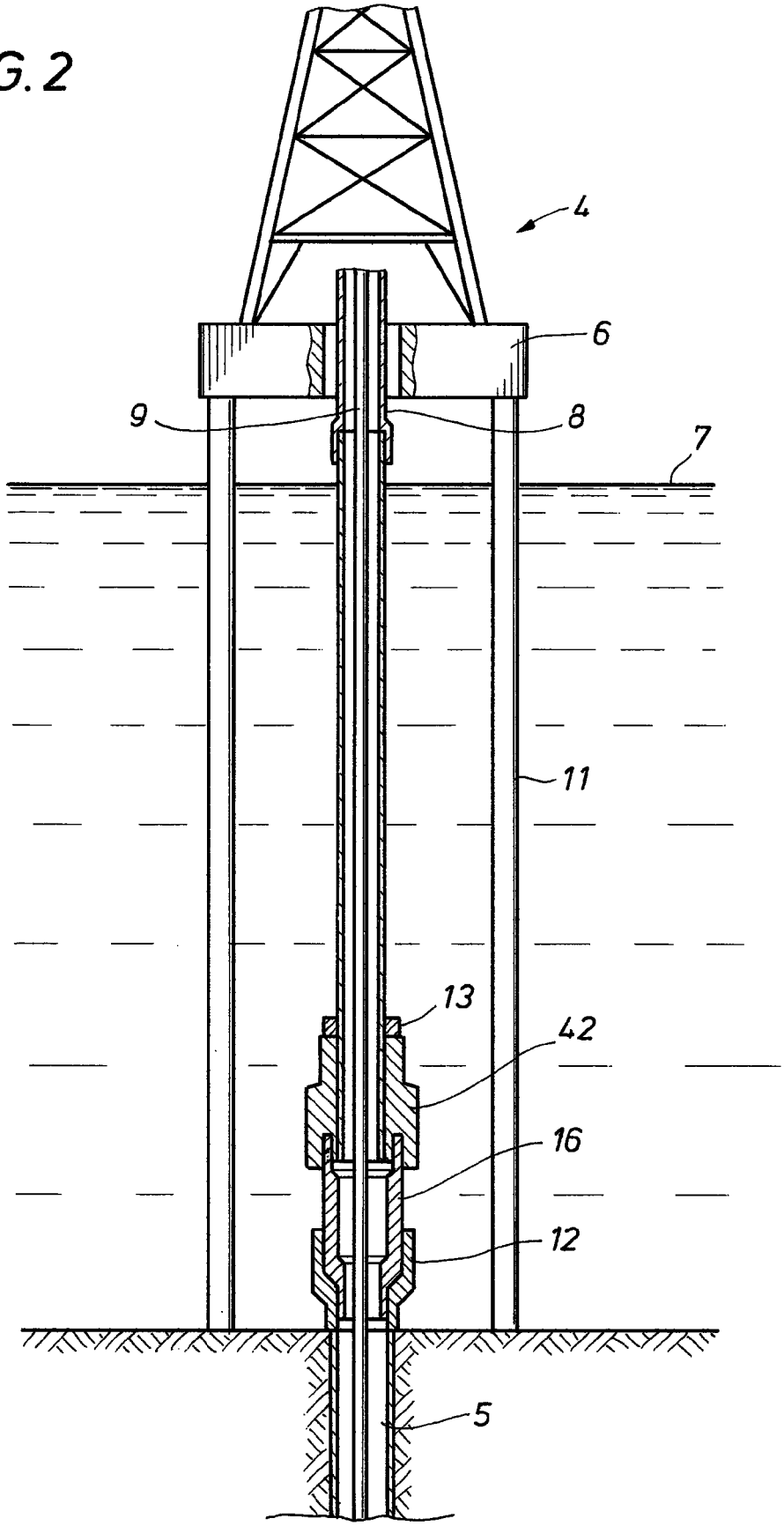
FIG. 2 is a schematic illustration of drilling through a large bore wellhead.

One of the advantages of the device illustrated herein is the flexibility of installing particular components of the wellhead assembly 10 and in what order. For example, the wellhead housings 12, 16 and tree 42 can be installed prior to drilling the wellbore 5. As noted above, the tree bore 56 diameter can accommodate a drill bit therethrough. Referring now to FIG. 2, a rig 4 for drilling the wellbore 5 is shown above the sea surface 7. An annular riser 8 is connected between the tree 42 and a platform 6 on the rig 4. A drill string 9 inserted through the riser 8 and tree bore 42 extends into the wellbore 5. A drill bit (not shown) on the drill string 9 lower end excavates the wellbore 5. The rig 4 includes legs 11 shown extending to the sea floor, however the present embodiment is not limited to this configuration and can include semi-submersible, jack-up, submersible, and a floating vessel. Optionally, a blowout preventer (BOP) 13 can be installed prior to drilling and the drilling can occur through the BOP 13 as well as the production tree 42.

Figure 3:
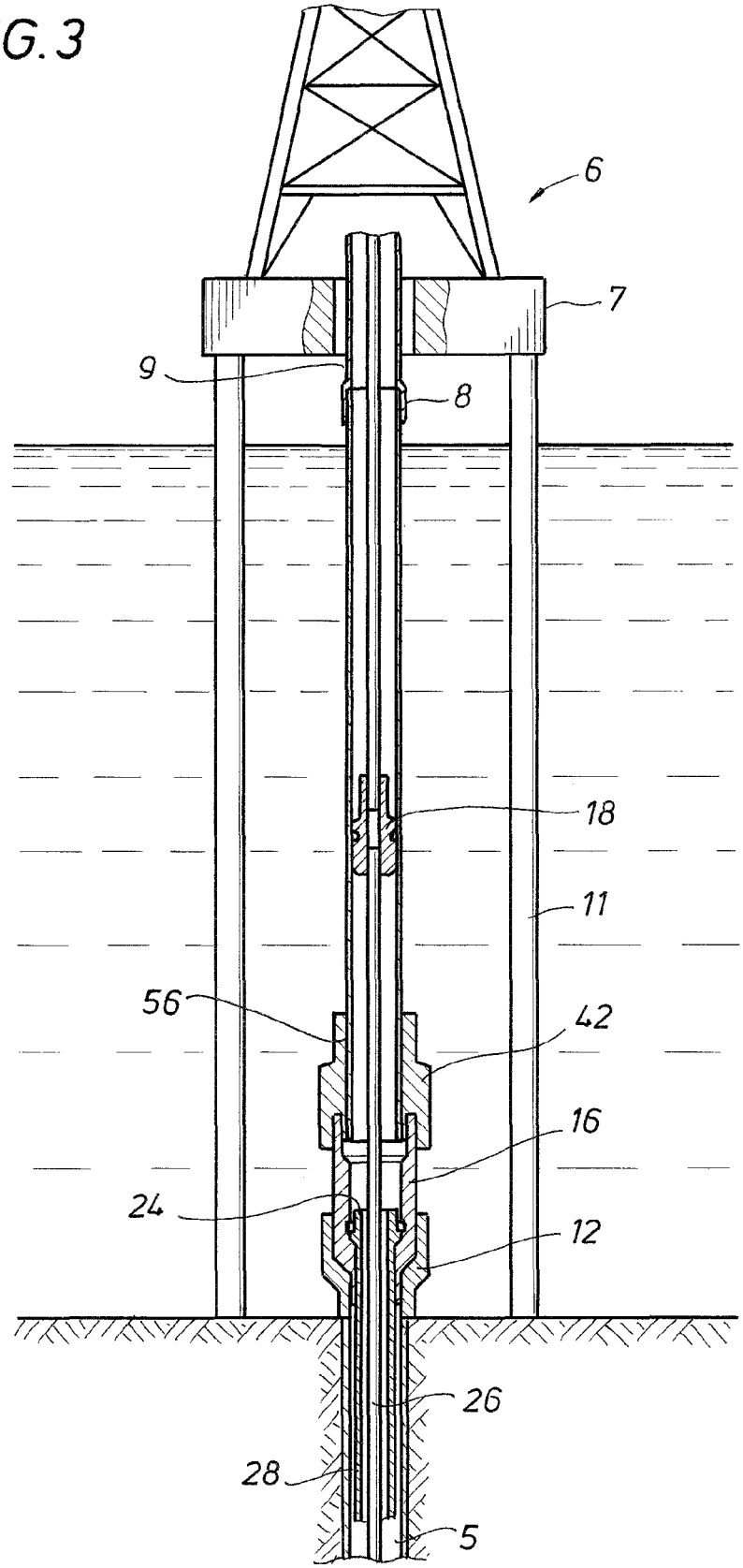
FIG. 3 is a schematic illustration of inserting tubing and a tubing hanger within the wellhead of FIG. 2.

Referring back to FIG. 1, after the wellbore 5 has been drilled to depth a tree cap 54 can be installed on the bore 56 upper end to prevent sea water ingress into the drilled wellbore 5. The tree cap 54 can be added before or after one of casing installation, tubing installation, or completing the wellbore 5. A remotely operated vehicle (not shown) may be employed to install/remove the tree cap 54. FIG. 3 schematically depicts a partial side sectional view of the tubing hanger 18 coupled on a drill string 9. Tubing 26 extends from the tubing hanger 18 through the production tree 42 and into the wellbore 5. In one example, FIG. 3 illustrates a step of completing a wellbore 5 by deploying and landing the tubing hanger 18 and attached tubing 26 into the wellhead housing 16. In another example, FIG. 3 depicts retrieving the tubing hanger 18 and tubing 26 that may occur during a workover procedure. The tree bore's 56 dimensions allow deployment and retrieval of the tubing hanger 18 and tubing 26 through the production tree 42.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A subsea wellhead assembly comprising:

a wellhead housing;

a production tree secured to the wellhead housing upper end, the production tree having a production port and an annulus port;

a tubing hanger releasably landed in the wellhead housing, the tubing hanger having an attached tubing string and a production passage formed therein;

a bore formed through the production tree having an inner diameter greater than the tubing hanger outer diameter, so that the tubing hanger can pass through the bore; and a hanger adapter disposed on the tubing hanger in the tree bore, the hanger adapter having an upper end below the tree production port and an axial bore registering with the tubing hanger production passage and in fluid communication with the tree production port.

2. The subsea wellhead assembly of claim 1, wherein the hanger adapter has an annular body with a flange member projecting radially outward from the annular body into sealing engagement with the tree bore defining an annulus chamber below the flange that is in communication with the annulus port.

3. The subsea wellhead assembly of claim 2, further comprising an actuation passage formed through the production tree, the hanger adapter, and tubing hanger leading exterior to the tree for controlling actuation of a downhole element.

4. The subsea wellhead assembly of claim 3, further comprising tubing attached to the tubing hanger and an actuator affixed on the tubing.

5. The subsea wellhead assembly of claim 4, further comprising a control line disposed through the actuation passage.

6. The subsea wellhead assembly of claim 1, further comprising a latch coupled between the tubing hanger and the wellhead housing.

7. The subsea wellhead assembly of claim 6, further comprising:

a tubing hanger annulus circumscribing a portion of the tubing hanger above the latch;

a tubing annulus passage through the wellhead housing to the tubing hanger annulus, the tubing hanger annulus being in communication with the annulus port of the tree.

8. The subsea wellhead assembly of claim 1, further comprising a valve in the tree bore above the hanger adapter, the valve selectively openable to form a passage adapted to receive the tubing hanger therethrough.

9. A subsea wellhead assembly comprising:

a wellhead housing;

a production tree secured to the wellhead housing upper end, the production tree having a production port and an annulus port;

a casing hanger having attached casing that projects into a wellbore;

a tubing hanger releasably landed in the wellhead housing defining an annular space between the tubing hanger upper portion and the tree bore, the tubing hanger having an attached tubing string disposed within the casing to form a tubing annulus therebetween, and a production passage formed axially through the tubing hanger;

an annulus passage through the wellhead housing and tubing hanger, so that a flow path is created between the tubing annulus and annulus port; a bore formed through the production tree having an inner diameter greater than the tubing hanger outer diameter, so that the tubing hanger can pass through the bore; and a hanger adapter disposed on the tubing hanger in the tree bore, the hanger adapter having an upper end below the tree production port and an axial bore registering with the tubing hanger production passage and in fluid communication with the tree production port.

10. The subsea wellhead assembly of claim 9, wherein the hanger adapter has an annular body with a flange member projecting radially outward from the annular body into sealing engagement with the tree bore.

11. The subsea wellhead assembly of claim 10, further comprising a passage laterally formed through the tree, extending radially through the flange and axially through the body, and axially through the tubing hanger to define an actuation passage between the tubing annulus and external to the tree.

* * * * *